US006975221B2

(12) United States Patent
Monck

(10) Patent No.: US 6,975,221 B2
(45) Date of Patent: Dec. 13, 2005

(54) LUGGAGE IDENTIFIER FOR AIR AND RAIL TRAVELERS

(76) Inventor: Joan M. Monck, 5 Spruce La., Warren, NJ (US) 07059

( * ) Notice: Subject to any disclaimer, the term of this patent is extended or adjusted under 35 U.S.C. 154(b) by 479 days.

(21) Appl. No.: 10/334,379

(22) Filed: Jan. 2, 2003

(65) Prior Publication Data

US 2004/0130447 A1 Jul. 8, 2004

(51) Int. Cl.[7] ..... G08B 1/08; G08B 13/14; G09F 17/00

(52) U.S. Cl. ..... 340/539.11; 340/571; 340/572.1; 116/173

(58) Field of Search ..... 340/539.1, 571, 340/572.1; 116/173

(56) References Cited

U.S. PATENT DOCUMENTS

| | | | | | |
|---|---|---|---|---|---|
| 5,278,556 | A | | 1/1994 | Oh | 340/988 |
| 5,388,546 | A | | 2/1995 | Lombard | 116/209 |
| 5,475,574 | A | | 12/1995 | Chien | 362/108 |
| 5,500,636 | A | | 3/1996 | Mitchell | 340/328 |
| 5,671,480 | A | * | 9/1997 | Krout et al. | 2/102 |
| 5,676,451 | A | | 10/1997 | Tabanera | 362/156 |
| 5,881,391 | A | * | 3/1999 | Mullaney | 2/209.13 |
| 5,899,167 | A | * | 5/1999 | Furman | 116/173 |
| 5,933,081 | A | | 8/1999 | Jones | 340/539 |
| 6,132,059 | A | | 10/2000 | Leibowitz | 362/156 |
| 6,133,832 | A | | 10/2000 | Winder et al. | 340/572.1 |
| 6,147,602 | A | | 11/2000 | Bender | 340/568.1 |
| 6,158,872 | A | | 12/2000 | Rodgers | 362/156 |
| 6,246,314 | B1 | | 6/2001 | Djaïd | 340/425.5 |
| 6,267,485 | B1 | | 7/2001 | Rodgers | 362/156 |

* cited by examiner

*Primary Examiner*—Jeffery Hofsass
*Assistant Examiner*—Lam Pham
(74) *Attorney, Agent, or Firm*—Ernest D. Buff & Associates, LLC; Ernest D. Buff; Dave Narasimhan

(57) ABSTRACT

A luggage identifier for air and rail travelers uniquely identifies a luggage piece on a airport carousel or train station conveyer belt. A battery powered remote radio wave transmitter carried by the passenger sends a radio wave to a battery powered receiving and activating mechanism associated with the luggage piece. The transmitted signal triggers a latch release mechanism connected to a flexible flagpole that is held under spring tension in the collapsed state. Upon being triggered, the latch release mechanism releases the flagpole, which is driven to an extended state under spring power. Identifiers carried by the flagpole are thereby moved into a conspicuously visible position, which facilitates identification of the luggage piece. The identifiers can comprise LED lights mounted on the flexible flagpole, a colored puffball, a name flag, and a sound generation mechanism. Additional identifiers can comprise a strip of light bulbs or LED lights disposed within cording of the luggage, a sewn-in housing light panel, and a privacy panel removably affixed to a sewn-in panel by hook and loop fasteners or the like. Flagpole extension proceeds to the extent permitted by the space available amongst contiguous luggage pieces. The component parts of the flagpole have sufficient flexibility to tolerate impact with adjacent objects, such as nearby baggage pieces or the edge of an airport carousel. Unique colors exhibited by the flag, and/or name identifiers on the pole operate to provide highly visible indicia that identify luggage or a backpack even in dimly lit areas.

9 Claims, 3 Drawing Sheets

LUGGAGE IDENTIFIER FOR AIR AND RAIL TRAVELERS

BACKGROUND OF THE INVENTION

1. Field of the Invention

The present invention relates to luggage identifiers for air and rail travelers; and more particularly to a method and means for readily identifying certain luggage items from a myriad of other luggage items having substantially the same size, shape and overall appearance.

2. Description of the Prior Art

Many approaches have been disclosed by prior art workers for identifying luggage in airport carousal or train stations. Remotely controlled locating devices have also used by prior art workers to locate automobiles in parking lots.

U.S. Pat. No. 5,278,556 to Oh discloses a remote-controlled, light emitting automobile locating alarm system. A remote control unit energizes a receiving unit located within an automobile. The receiving unit detects a signal from the remote control unit, using an antenna. It turns on lights and activates motion of an animal character to attract the attention of the user. The receiving unit may also activate an audible alarm. No disclosure is contained by the '556 patent concerning location of luggage in an airport carousel or train station.

U.S. Pat. No. 5,388,546 to Lombard discloses an automobile locator device. A pennant having good visibility is attached to a pole mounted on a magnetic base. The device can be removably placed on the roof of an automobile. A magnetic base is rotated by 360 degrees to present an optimal view of the pennant, so that the motorist can easily locate the parked automobile. The magnetic base is attached to the interior of the article to prevent unauthorized removal of the locating device. No disclosure is contained by the '546 patent concerning location of luggage in an airport carousel or train station.

U.S. Pat. No. 5,475,574 to Chien discloses a shoulder band having an EL (electroluminescence) light strip. The electroluminescent strip is attached to the shoulder strap. It is powered through a switch by a circuit consisting of a battery, DC/AC converter and transformer, and carries decorative or nametag masks placed over the EL strip. The EL strip improves the visibility of the wearer particularly for nighttime motor vehicle drivers. Since EL strips operate at high DC voltages these devices will not sustain luggage handlers in an airport carousal or train station. Significantly, the illumination device is not remotely controlled and does not assist in locating the bag from a group of similar looking bags on an airport carousel or conveyor belt.

U.S. Pat. No. 5,500,636 to Mitchell discloses a talking luggage device. A tape recorder is removably attached to luggage and identifies the luggage owner by audible means. The tape recorder accesses and plays a prerecorded message when a button is pushed to obtain owner information and destination. New messages can be placed on the tape recorder to provide updated information. The device disclosed does not find baggage amongst several similar looking units on an airport conveyor belt in a short time. Identification of a bag must be achieved in order that a button thereon can be pushed; this is not readily accomplished in an airport or train station environment that is noisy and wherein luggage moves rapidly on a conveyor belt or airport carousal.

U.S. Pat. No. 5.676,451 to Tabanera discloses an electroluminescent jacket and bag. A jacket or a back may be fitted with a detachable electroluminescent strip powered by a battery, and a DC/AC inverter. The electroluminescent strip is held in place using a retainer. A battery and an inverter contained in pouch powers the electroluminescent strip. Such a device does not perform a luggage-locating function. It is not remotely actuated, and does not selectively identify a piece of baggage within a short time amongst several similar looking units on an airport conveyor belt or carousel.

U.S. Pat. No. 5,933,081 to Jones discloses a device for aiding in the location of an automobile. It uses a remote controller, which activates an illuminating device attached to the bottom of the antenna. The illuminating device has decorative shape and fiber optic wave-guides. It directs and illuminates the length of the antenna. Optionally, a sound-generating device may also be activated by the remote control. The '081 patent does not disclose a luggage-locating device. No means are suggested therein for rapidly locating an article of luggage amongst several similar looking units on an airport conveyor belt or carousel.

U.S. Pat. No. 6,132,059 to Leibowitz discloses a satchel having an illuminated display. The illuminating light source is securely placed within the satchel. Illumination is viewed through a transparent portion of the satchel. The illuminating light can be flashed using a flashing circuit. The device disclosed by the '059 patent does not perform a luggage-locating function. It cannot be operated remotely to rapidly select an article of luggage from amongst several similar looking units on an airport conveyor or carousel.

U.S. Pat. No. 6,133,832 to Winder et al. discloses article-locating system. Several identical tags having different face code numbers respond to different coded radio signals from a transmitter. Both the transmitter and receiver carry their own power source and operating circuits. When the tag receives its coded radio transmission, it emits a laser beam generated by laser diodes. It is moved using a piezoelectric element to provide a scanning laser beam, which can be easily detected. The tag also has sound generating capability and aids in locating the article. Such a device is nor operable for a very long time and could not readily be attached to a bag and located on an airport conveyor belt. To be operable, an exact code has to be provided by the transmitter. In addition, the object has to be viewed within a narrow angular range to observe the light emitted by the laser diode. This presents significant operational drawbacks, since other objects may completely cover the laser diode light. Similarly, the sound generated would likely be too weak to be heard in the noisy environment of an airport. In operation, the detector and sound generation, as well as the transmitter generation would consume significant power, limiting the useful life of the device. This is especially so considering the size of the tag that is described by the '832 patent.

U.S. Pat. No. 6,147,602 to Bender discloses a carrying bag, which has a light on the outside so that the bag is visible. The lights are controlled by a timing circuit, turned on for a set period by the "off to on" transition of a motion responsive switch occurring outside the set period. With this arrangement, motion response is ignored if the lights are turned on. In operation, the lights are turned on by motion sensors, which activate the lights when the bag is moved. Upon being activated, the light remains in the "on" condition for a set period of time. Alternatively, the lights may be turned on manually. No disclosure is contained in the '602 patent concerning a backpack locating device that aids in locating a bag or backpack amongst similar bags on an airport conveyor belt or carousel.

U.S. Pat. No. 6,158,872 to Rodgers discloses a luggage locator system. A transmitter sends a coded radio frequency signal to a receiver, which attached to or incorporated into an object to be detected. As long as the transmitter is turned on, the receiver illuminates a lighting element and may optionally turn on sound. The lighting element may be coupled to a light pipe, which encircles the perimeter of the object to improve visibility. The user scans the area with the transmitter turned on to locate the object, which carries the receiver. With the transmitter in the "on" condition, the user looks for an article of baggage, which is identified by emission of light, the glow of a light pipe or the sound of an alarm. Requiring the transmitter to be turned on for the light and sound features to be functional conserves battery life for the transmitter and the receiver units; but is oftentimes ineffective since the angular range of a light pipe is small and sound is frequently not detectable in a noisy environment when luggage is moving rapidly on a conveyor belt or carousal.

U.S. Pat. No. 6,246,314 to Djaid discloses a vehicle locator device. A deployable arm is mounted on the luggage fixture or roof of an automobile. Normally horizontal, the deployable arm is raised to a vertical position using a motor drive (44) and screw thread and nut device (62, 64) on command from a remote control. The arm carries lights and generates audible sound so that vehicle can be located. A vehicle locator device is permanently attached to the luggage fixture or roof of a vehicle. Normally, the locator device is in the retracted horizontal position. When a remote controller is activated, the vehicle locator device receives the remote control signal. The arm is deployed into a vertical position by turning a lead screw 64 using a motor drive 44. Lug nut assemblies on the lead screw 62 moves the resting position of the lever 56, thereby raising the deployable arm 52 into the vertical position. Deployable arm 52 carries a light to indicate the location of the vehicle. The vehicle locator device is retracted back to the horizontal position after being used. It does not perform a luggage-locating function.

U.S. Pat. No. 6,267,485 to Rodgers discloses a carrying bag, which has a light on the outside so that the bag is visible. The lights are controlled by a timing circuit, turned on for a set period by an "off to on" transition of a motion responsive switch occurring outside the set period. Motion response is ignored if the lights are turned on. The lights can be turned on manually. The device disclosed by the '485 patent does not facilitate location of a bag amongst similar bags on an airport carousel or train station conveyor belt.

There remains a need in the art for a luggage-locating device that can withstand handling by luggage porters and mechanical devices, such as conveyers and carousals. During operation of such luggage portage equipment, pieces of luggage collide easily, with the result that loosely attached detection devices are readily dislodged. Luggage pieces oftentimes have very similar appearance, and the only identifier present is the passenger's nametag and luggage code number affixed by airline personnel at check-in. During handling of luggage in airports and rail terminals these small tags are frequently lost or destroyed, causing significant time to be spent locating a luggage piece.

There is also a need for a device that minimizes use of electrical power. A power pack, required for operation of the device, must to be carried by the luggage; it should be light, compact, and not subject to rapid exhaustion. Unique identification of baggage must be readily and quickly accomplished in noisy, brightly lit environments, such as those extant in railroad or airport baggage delivery areas. None of the prior art disclosures provide solutions for these problems.

Accordingly, there remains a need in the art for a luggage identification mechanism that is lightweight and compact. Also needed is a luggage identification means that can operate for a prolonged period of time within a noisy, brightly-lit environment; and which clearly and quickly signals the identity of preselected luggage units from amongst numerous luggage units having substantially identical size, shape and appearance that are moving rapidly on an airport carousal or conveyor belt.

SUMMARY OF THE INVENTION

The present invention provides a luggage identifier for air and rail travelers, which is lightweight and compact. It requires minimal electrical power, and operates for prolonged periods of time within a noisy, brightly lit environment. Clear and certain identification of preselected luggage units is readily accomplished, notwithstanding the presence of numerous luggage items having substantially the same size, shape and overall appearance.

Generally stated, the luggage identifier comprises two components, namely, an activating transmitter means, and a receiving and activating means externally incorporated or attached to the luggage unit. One form of transmitter means that is suitable comprises a car key transmitter, or the like. The receiving and activating means is externally incorporated or attached to the luggage unit. It is operative, upon receipt of a radio signal from the transmitter means, to release and telescopically raise a flexible flagpole bearing lights, audible signals, distinctive colors, or an individual's name. Due to its distinctive markings or audible signals, the flexible flagpole when actuated is readily identified.

The flexible flagpole is released from a holding latch when the radio signal is received; and is easily rearmed by the user. Rearming is accomplished by pushing the flexible flagpole into the latch and pressing against a resilient spring member. Due to use of spring actuation, battery power is only used to effect receipt of the transmitter signal and release of the latch. The spring action essentially pushes the flexible pole from its collapsed state to the extended state. In addition to use of remote latch actuation and spring driven movement of a flexible pole bearing unique identifiers, as stated above, additional visible identifiers can, optionally, be provided. Preferably, such additional visible identifiers can comprise: (i) a strip of light bulbs or LED lights in the luggage cording; (ii) sewn-in panel housing lights powered by an on-board battery; and (iii) a privacy panel removably affixed to a sewn-in panel by Velcro fasteners or the like. The privacy panel can be pealed back to reveal a traveler's name, address and telephone number (optionally set forth in a foreign language for convenience of foreigners surveying luggage at the destination airport). With these identifiers, luggage retrieval is readily accomplished in dimly lit or even dark conditions.

The Luggage Identifier for Air and Rail Travelers may be advantageously deployed as a removable attachment to bags, or permanently built -in within the exterior of the luggage or backpack. Upon deployment, the unit provides a highly visible signal comprised of lights, a flag, and/or an audio signal mounted on or emanating from a flexible pole. The signal, as well as the pole extension, can be actuated by receipt of a radio signal from a remote battery powered transmitter carried by the passenger. Unique colors exhibited by the flag, and/or name identifiers on the pole operate to provide highly visible indicia that identify luggage or a backpack even in dimly lit areas.

BRIEF DESCRIPTION OF DRAWINGS

The invention will be more fully understood and further advantages will become apparent when reference is had to the following detailed description and the accompanying drawings, in which:

FIG. 3 is a schematic diagram depicting additional identifiers provided on the bag in addition to the flexible flagpole extending from the baggage, the additional identifiers comprising (i) a strip of light bulbs or LED lights 18 in the luggage cording; (ii) a sewn-in panel housing lights 19 powered by an on-board battery; and (iii) a privacy panel 20 removably affixed to a sewn-in panel by Velcro fasteners or the like.

DESCRIPTION OF THE PREFERRED EMBODIMENTS

The present invention provides a luggage identifier for air and rail travelers comprising two components. A battery powered activating remote transmitter is carried by the passenger. Externally incorporated or attached to the luggage unit is a receiving and activating device. Upon activation, the receiving and activating device provides a unique visible identifier that aids the location of preselected baggage units on an airport carrousel or conveyor belt.

The Luggage Identifier for Air and Rail Travelers comprises a flexible pole, which is released by a latch upon receipt of a pre-selected radio frequency signal from a remote transmitter. The flexible pole and latch are housed in a pouch. Also housed within the pouch are a radio frequency receiving circuit and a power supply, which typically comprises an on-board battery. The pouch can be removably attached or integrally fixed to a piece of luggage or backpack. Information carried by the flexible flagpole uniquely identifying the piece of luggage. Identifiers can comprise a uniquely colored flag; or a puffy ball; or an individual's name; or a set of lights; or a sound-generating device. A lighted flagpole enables baggage location to be accomplished quickly and reliably, even in dimly lit surroundings. Due to the extreme flexibility of the pole device and its unique anchoring to the luggage it can withstand impact with other luggage pieces or edges of a carousel.

Figure 1:
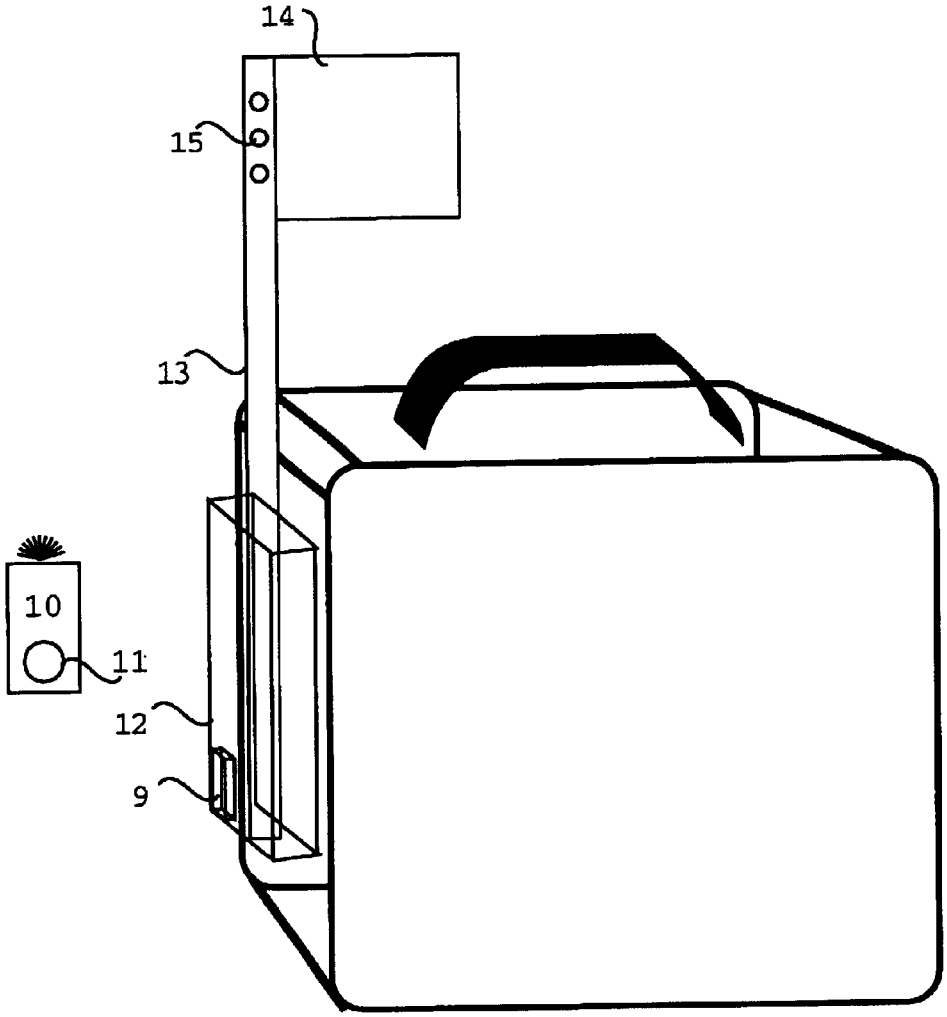
FIG. 1 is a schematic diagram of the Luggage Identifier for Air and Rail Travelers showing the battery powered remote transmitter 10 and the receiving and activating unit 12 attached to the baggage.

In FIG. 1 there is shown a schematic diagram of the Luggage Identifier for Air and Rail Travelers. The unit is actuated by a battery-powered remote transmitting device 10 carried by the passenger. When the button 11 is pushed, transmitting device 10 emits a radio frequency signal. A receiving and activating unit 12 located on the luggage detects the radio frequency signal and actuates a spring driven mechanism. Electrical power for actuating unit 12 is provided by batteries 9. Upon actuation, the spring driven mechanism operates to extend a flexible pole 13. The pole 13 carries a flag bearing unique colors and/or an individual's name 14. It may also carry a plurality of lights 15.

Figure 2:
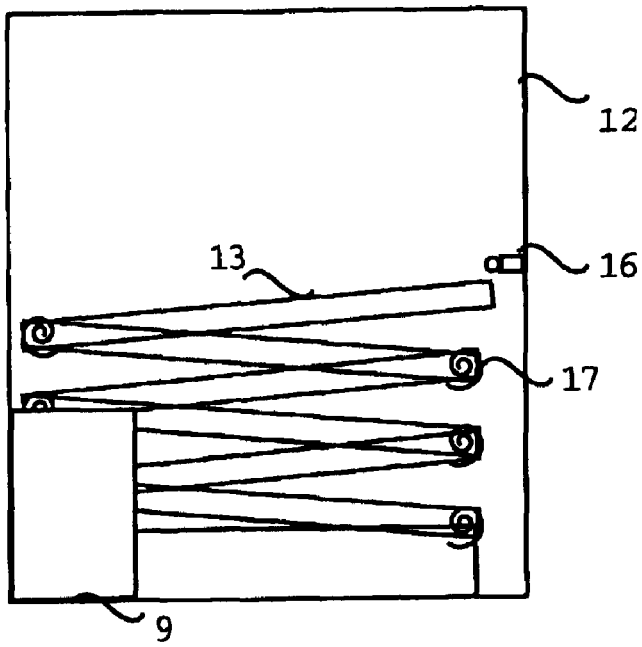
FIG. 2 is a schematic diagram depicting construction details for the receiver box 12.

In FIG. 2 there are shown construction details for the receiver box 12. Flexible flagpole 13 is released by trigger latch 16. The pole 13 has a collapsed mode and an extended mode. During portage, the pole remains in a folded position, being held therein against spring tension by hinge 17. The battery pack 9 in the receiving and activating unit powers the radio frequency detecting circuit, which is always turned on waiting for the remote transmitter signal. When the transmitter signal is received, the activating unit activates the trigger latch release mechanism 16. Flagpole 13 is released, and the spring tension provides motive force at hinge 17, driving the flexible flagpole to an extended condition. The mechanical arrangement shown by FIG. 2 is but one of several mechanical arrangements that are operative to extend the flagpole 13. It will be understood by those skilled in the art that other arrangements may be suitably employed to drive the flagpole 13 from a collapsed condition to an extended condition.

Figure 3:
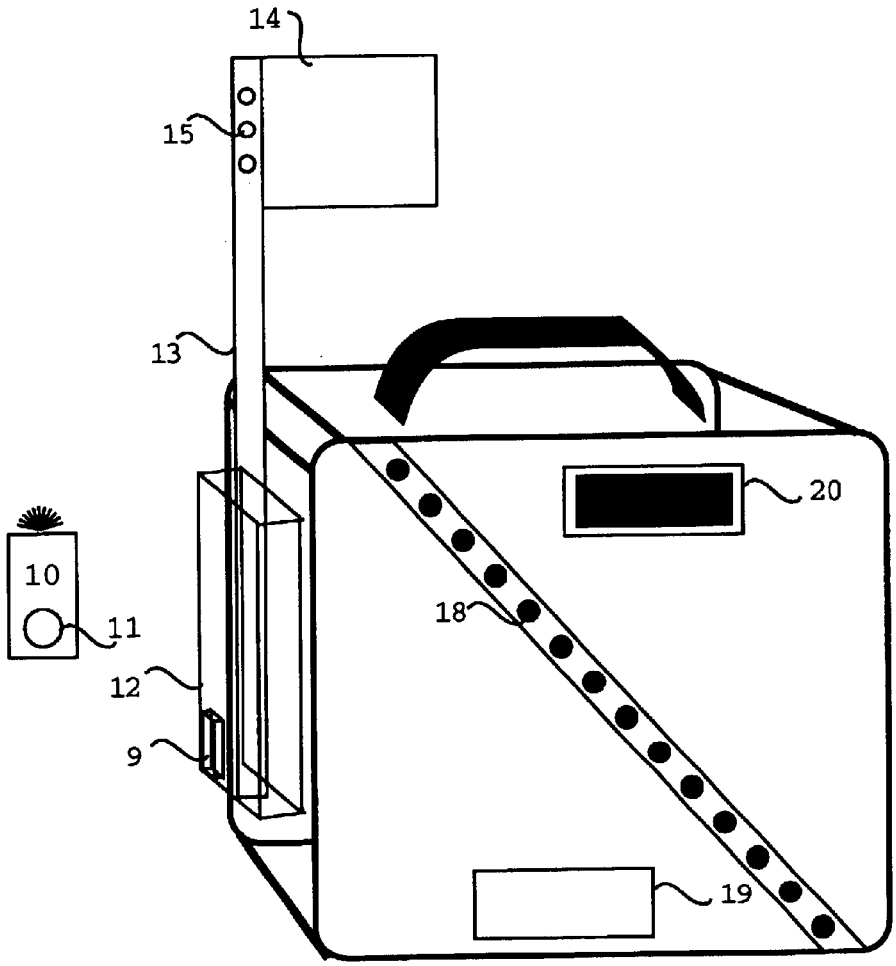

In FIG. 3 there are shown details of other indicating devices that may be provided on the bag to allow easy identification of luggage on an airport carousal or train station conveyor belt. Identification means provided on the bag in addition to the flexible flagpole 13 can comprise: (i) a strip of light bulbs or LED lights in the luggage cording 18; (ii) a sewn-in panel housing lights 19; and (iii) a privacy panel 20 removably affixed to a sewn-in panel by hook and loop fasteners such as Velcro® strip or the like. The privacy panel can be pealed back to reveal a traveler's name, address and telephone number; and each of these indicia may, optionally, be set forth in a foreign language for convenience of foreigners surveying luggage at the destination airport. Battery pack 9 provides power to the strip of light bulbs or LEDS, or the sewn in light panel, when a radio-transmitted signal is received by the receiving and activating unit 12.

Trigger latch 16 is actuated when receiver 12 detects a pre-selected radio frequency from transmitter 10. Latch 16 retracts. The flexible flagpole 13 is moved to an extended position by spring power emanating from hinge 17; and unique luggage identifiers are prominently displayed. Identifiers mounted on the flexible flagpole can comprise one or more flags bearing unique colors, patterns or shapes; or a flag carrying an individual's name; or a puffy ball; or a set of lights, including light emitting diodes; or a sound generating device containing miniature speakers or piezo sound generators (not shown). The flexible character of the flagpole, and the unique signature presented by the indicating devices enables luggage identification to be readily accomplished with baggage handling machinery such as airport conveyors and the like. With such machinery, travelers have limited time to identify and retrieve their baggage from a myriad of similarly shaped luggage pieces. Advantageously, a lighted flagpole conspicuously signals the location of luggage, enhancing prospects for its quick, accurate identification, even in dimly lit areas.

Materials used when constructing the flagpole comprise high strength steel or fiber reinforced polymeric materials. The reinforcing fibers can comprise E-glass, graphite fibers and the like, which combine high elastic modulus and significant flexibility with high fracture resistance. The hinges 17 of FIG. 2 provide additional locations in which the flagpole can relax, accommodating instances where it impacts with other luggage and/or the edges of a carousel. The flagpole will extend to its fullest extent when free space is available, thereby maximizing the opportunity for unique identification of luggage with which it is associated. The LED devices are connected within the pole, using highly flexible electrical wiring. Preferably, the wiring is constructed of tape composed of multiple thin, fine wires, which readily accommodate flexing of the flagpole.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A luggage identifier for air and rail travelers, comprising:

a. a battery powered remote radio wave activating transmitter means carried by the passenger for providing a transmitted radio signal to activate an identification means in a luggage piece;

b. a battery powered receiving and activating means connected to said luggage piece for receiving the transmitted radio signal and activating said identification means;

c. a triggered latch release means electrically connected to said receiving and activating means for triggering release of a flexible flagpole, which is moved by spring power from a collapsed state to a fully extended state, said trigger latch release means being activated by said receiving and activating means upon receipt of said transmitted radio signal;

d. a flexible flagpole collapsing means comprising a plurality of spring loaded hinges adapted to accommodate folding of the flexible flagpole into a small space, wherein it is held in a collapsed state by said triggered latch release means; and e. an identification means carried by said flexible flagpole for facilitating identification of said luggage piece from amongst a plurality of substantially identical luggage pieces on a airport carousel or train station conveyor belt.

2. A luggage identifier for air and rail travelers as recited by claim 1, wherein the said triggered latch release means includes a latch adapted to away and thereby release a collapsed spring-loaded, flexible flagpole.

3. A luggage identifier for air and rail travelers as recited by claim 1, wherein said flexible flagpole collapsing means includes a plurality of straight sections of said flexible flagpole, said sections being connected with multiple hinges, and loaded with helical springs placed under tension by collapsing action of said sections.

4. A luggage identifier for air and rail travelers as recited by claim 1, wherein the said identification means includes a plurality of LED lights attached to the flexible flagpole and powered by flexible multi-filament flexible wiring.

5. A luggage identifier for air and rail travelers as recited by claim 1, wherein the said identification means includes a colored puffball.

6. A luggage identifier for air and rail travelers as recited by claim 1, wherein the said identification means includes a flag carrying a name identifier.

7. A luggage identifier for air and rail travelers as recited by claim 1, wherein the said identification means includes a sound generation means.

8. In a method for identifying a luggage piece on an airport carousel or train station conveyor belt, the improvement wherein a remote radio wave transmitter actuates a latch release means connected to a flexible flagpole that is held in a collapsed state under spring tension, driving said flagpole to an extended state under spring power, and causing identifiers carried by the flagpole to become visibly conspicuous, so that identification of said luggage piece from amongst a plurality of similarly shaped luggage pieces is facilitated.

9. A method for identifying a luggage piece, as recited by claim 8, wherein said identifiers include LED lights, a colored puffball, a name flag, a light strip disposed within a cording strip of said luggage piece, and a sewn-in housing light panel.

* * * * *